US009682459B2

(12) United States Patent
Kata

(10) Patent No.: US 9,682,459 B2
(45) Date of Patent: Jun. 20, 2017

(54) ABRASIVE NOZZLE HEAD

(71) Applicant: SUGINO MACHINE LIMITED, Uozu, Toyama Prefecture (JP)

(72) Inventor: Akira Kata, Toyama (JP)

(73) Assignee: SUGINO MACHINE LIMITED, Uozu (JP)

( * ) Notice: Subject to any disclaimer, the term of this patent is extended or adjusted under 35 U.S.C. 154(b) by 9 days.

(21) Appl. No.: 14/932,453

(22) Filed: Nov. 4, 2015

(65) Prior Publication Data

US 2016/0129551 A1 May 12, 2016

(30) Foreign Application Priority Data

Nov. 7, 2014 (JP) ..... 2014-226933

(51) Int. Cl.
*B24B 5/04* (2006.01)
*B24C 5/04* (2006.01)
*B24C 1/04* (2006.01)

(52) U.S. Cl.
CPC ..... *B24C 5/04* (2013.01); *B24C 1/045* (2013.01)

(58) Field of Classification Search
CPC ..... B24C 1/045; B24C 5/02; B24C 5/04
See application file for complete search history.

(56) References Cited

U.S. PATENT DOCUMENTS 5,320,289 A 6/1994 Hashish et al.
6,601,783 B2 8/2003 Chisum et al.
8,439,726 B2 * 5/2013 Miller ..... B24C 1/045 451/102
8,783,146 B2 * 7/2014 Chacko ..... B24C 5/02 239/587.1
9,346,147 B2 * 5/2016 Chalmers ..... B24C 7/0007
2004/0107810 A1 * 6/2004 Sciulli ..... B24C 1/045 83/177
2005/0233682 A1 * 10/2005 Chisum ..... B24C 5/04 451/102

(Continued)

FOREIGN PATENT DOCUMENTS

EP 0983823 A1 3/2000
JP H06328365 A 11/1994

OTHER PUBLICATIONS

Mar. 23, 2016 Extended European Search Report issued in European Patent Application No. 15193124.3.

*Primary Examiner* — Timothy V Eley
(74) *Attorney, Agent, or Firm* — Oliff PLC

(57) ABSTRACT

The abrasive nozzle head includes, within a hollow head body mounted to a nozzle adapter supplying high pressure water: a water nozzle; a mixing chamber; and an abrasive nozzle, which are arranged coaxially with the nozzle adapter. The abrasive nozzle head is provided with an abrasive supply portion that supplies an abrasive to the mixing chamber. The head body has a recessed hole formed by drilling from a side surface, the recessed hole intersecting with the jet axis of a water jet. A mixer member is removably inserted into the recessed hole, and formed with the mixing chamber and an abrasive supply port. The abrasive nozzle head also includes: a positioning portion that positions the mixing chamber coaxially with the water nozzle and the abrasive nozzle when the mixer member is fully inserted; and a fixing portion that releasably fixes the mixer member in the fully inserted position.

5 Claims, 4 Drawing Sheets

(56) References Cited

U.S. PATENT DOCUMENTS

| | | | | |
|---|---|---|---|---|
| 2013/0267152 | A1* | 10/2013 | Tera | B24C 1/045<br>451/99 |
| 2014/0329445 | A1* | 11/2014 | Traini | B24C 5/04<br>451/102 |
| 2015/0202740 | A1* | 7/2015 | Nambiath | B24C 5/04<br>451/102 |

* cited by examiner

ABRASIVE NOZZLE HEAD

BACKGROUND

1. Field of the Invention

The present invention relates to an abrasive nozzle head of an abrasive water jet device which directs onto a workpiece an abrasive water jet obtained by mixing a abrasive into high pressure water.

2. Description of the Related Art

In the past, an abrasive water jet obtained by mixing a abrasive into high pressure water jet has been used to cut a workpiece or the like. A device for discharging such abrasive water jet is of a type in which high pressure water is jetted from an abrasive nozzle while passing from a water nozzle through a mixing chamber, thereby generating negative pressure in the mixing chamber, and taking the abrasive into the mixing chamber using the negative pressure, in order to discharge an abrasive water jet while mixing the abrasive into the high pressure water.

For example, as shown in FIG. 6, a common abrasive nozzle head 41 for use in the device of this type includes a hollow head body 42 that is mounted to a nozzle adapter 50 supplying high pressure water. The interior of the head body 42 includes: a water nozzle 43 that jets high pressure water; a mixer member 44 that is formed with a abrasive supply port 45 into which a abrasive is introduced, and a mixing chamber 46 for mixing the abrasive supplied from the supply port 45 into the high pressure water; and an abrasive nozzle 47 that discharges an abrasive water jet obtained by mixing the abrasive into the high pressure water, the water nozzle 43, the mixer member 44, and the abrasive nozzle 47 being arranged coaxially with the jet axis X of the water jet (see, for example, Japanese Unexamined Patent Application Publication No. Hei 6-328365 and U.S. Pat. No. 6,601,783).

The water nozzle 43, mixer member 44, abrasive nozzle 47 and the like are consumable components which wear out from use and need replacement. These consumable components are configured from components independent of one another for the purpose of appropriate replacement if necessary, and coaxially incorporated and fixed in the hollow head body.

Further, typically, as shown in FIG. 6, a side hole 48 exposing the abrasive supply port 45 is formed by drilling in a side surface of the head body. A abrasive supply hose 51 is connected to the head body through a hose adapter 52 inserted into the side hole 48, and communicates with the abrasive supply port 45.

However, the consumable components, which are incorporated in the head body and independent of one another, as described above, are of different replacement timings. For example, as for the service life of each consumable component which corresponds to the replacement interval, while the water nozzle has a relatively long life of 500 to 1000 hours, that of the abrasive nozzle is 70 to 100 hours; that of the mixer member is 150 to 300 hours; and that of the hose adapter is 150 to 300 hours. Although these service lives are reference values (because the water nozzle depends on ON/OFF times and the components other than the water nozzle depend on the amount of abrasive to be supplied), it is apparent that their service lives differ from one another. Therefore, in some cases, there has arisen a need for disassembling the whole abrasive head including other components which do not need to be replaced at the time of replacement of a component to be replaced.

For example, in the abrasive nozzle head 41 of FIG. 6, at the time of replacement of the mixer member 44, firstly by loosening each fixing nut 49 and removing the abrasive nozzle 47 from the head body 42, and then removing the head body 42 from the nozzle adapter 50, and also then, by removing the mixer member 44 from the head body 42, and removing the water nozzle 43 from the mixer member 44, the single mixer member 44 is removed from the abrasive nozzle head 41. Then, after mounting the water nozzle 43 to a new mixer member 44, the new mixer member 44 is attached to the head body 42, then the head body 42 is attached to the nozzle adapter 50, and then the previously-removed abrasive nozzles 47 are sequentially attached to the head body 42, thereby completing the replacement of the mixer member 44. In this manner, at least eight processes have been necessary for the replacement work of the mixer member 44.

Furthermore, in some abrasive nozzle heads of the related art, the water nozzle 43 is replaceably fitted and disposed in a recess that is formed on the upstream end side of the mixer member 44 as shown in FIG. 6. In this case, as described above, every time the mixer member 44 is replaced, the water nozzle 43 is also removed even if it does not need to be replaced. Although the service life of the water nozzle is typically several times longer than the mixer member, repetition of the removal work associated with the replacement of the mixer member could result in the early occurrence of seal failure in some sealing forms. Further, replacement of such water nozzle mounted to the mixer member is also performed by the procedure that requires the disassembly of the whole abrasive head.

As described above, in the abrasive nozzle head of the related art, it has taken troublesome labor and time to replace consumable components, particularly, the mixer member.

Accordingly, in view of the above-described problem, an object of the present invention is to provide an abrasive nozzle head which includes a configuration that makes the replacement of a mixer member easier than the related art.

SUMMARY

In order to achieve the above-described object, a first aspect of the present invention provides an abrasive nozzle head which includes a hollow head body that is mounted to a nozzle adapter supplying high pressure water. The interior of the head body includes: a water nozzle that jets high pressure water; a mixing chamber where a abrasive is mixed into a water jet from the water nozzle; and an abrasive nozzle that discharges an abrasive water jet from the mixing chamber. The water nozzle, the mixing chamber, and the abrasive nozzle are arranged coaxially with the nozzle adapter. The abrasive nozzle head is provided with a abrasive supply portion that supplies the abrasive to the mixing chamber through the head body. The head body has a recessed hole formed by drilling from a side surface of the head body, the recessed hole intersecting with a jet axis of the water jet. The abrasive nozzle head includes: a mixer member that is removably inserted into the recessed hole from outside the head body, and formed with the mixing chamber and a abrasive supply port introducing the abrasive into the mixing chamber; a positioning portion that positions the mixing chamber coaxially with the water nozzle and the abrasive nozzle when the mixer member is fully inserted; and a fixing portion that releaceably fixes the fully inserted position of the mixer member.

Preferably the positioning portion includes fitting portions that are formed on an outer peripheral portion of the mixer member and around an opening of the recessed hole and shaped to fit each other. Also preferably, with the fitting portions fitted together, the mixing chamber is positioned coaxially with the water nozzle and the abrasive nozzle, thereby providing the fully inserted position of the mixer member.

Preferably the abrasive supply portion includes a abrasive supply hose adapter that is integrally provided on the mixer member, the abrasive supply hose adapter having a flow passage, the flow passage communicating with the abrasive supply port.

Preferably the head body has: a recess that is formed on the downstream end side of the nozzle adapter; and a flow passage that extends coaxially with the nozzle adapter from the center of a bottom of the recess so as to communicate with the mixing chamber of the mixer member inserted into the recessed hole. Also preferably, the water nozzle is replaceably fitted and disposed in the recess.

Preferably the mixer member is provided with an abrasive nozzle recess in which, with the mixer member in the fully inserted position, an upstream end portion of the abrasive nozzle can be fitted.

A second aspect of the present invention provides an abrasive water jet cutting device including the abrasive nozzle head.

In the abrasive nozzle head according to the first aspect of the present invention, the recessed hole intersecting with the jet axis of the water jet is formed by drilling from a side surface of the head body. Also, the mixer member, which is formed with: the mixing chamber; and the abrasive supply port introducing the abrasive into the mixing chamber, is removably inserted into the recessed hole from outside the head body. Thus, there are the advantages that replacement can be easily made mainly only by removing and inserting the mixer member from and into the recessed hole of the head body without disassembling the whole nozzle head, and the working time required for replacing the mixer member is drastically reduced in comparison with the related art.

BRIEF DESCRIPTION OF THE DRAWINGS

Non-limiting and non-exhaustive embodiments of the present embodiments are described with reference to the following FIGURES, wherein like reference signs refer to like parts throughout the various views unless otherwise specified.

FIGS. 2A and 2B are schematic sectional views showing the configuration of a fitting portion between a mixer member and the periphery of the opening of a recessed hole according to this embodiment, wherein FIG. 2A is a sectional view taken along arrowed line A-A of FIG. 1 and FIG. 2B is a sectional view taken along arrowed line C-C of FIG. 2A.

FIGS. 3A and 3B are schematic fragmentary perspective views each showing the inserted position of the mixer member in the recessed hole according to this embodiment, wherein FIG. 3A shows a partway inserted position and FIG. 3B shows a fully inserted position.

FIGS. 4A and 4B are schematic longitudinal sectional views illustrating a state where the mixer member and an abrasive nozzle are fitted together according to this embodiment, wherein FIG. 4A is a sectional view taken along arrowed line B-B of FIG. 1 and FIG. 4B is a sectional view showing a comparative example of the case where the mixer member and the abrasive nozzle are not fitted.

DETAILED DESCRIPTION

Figure 1:
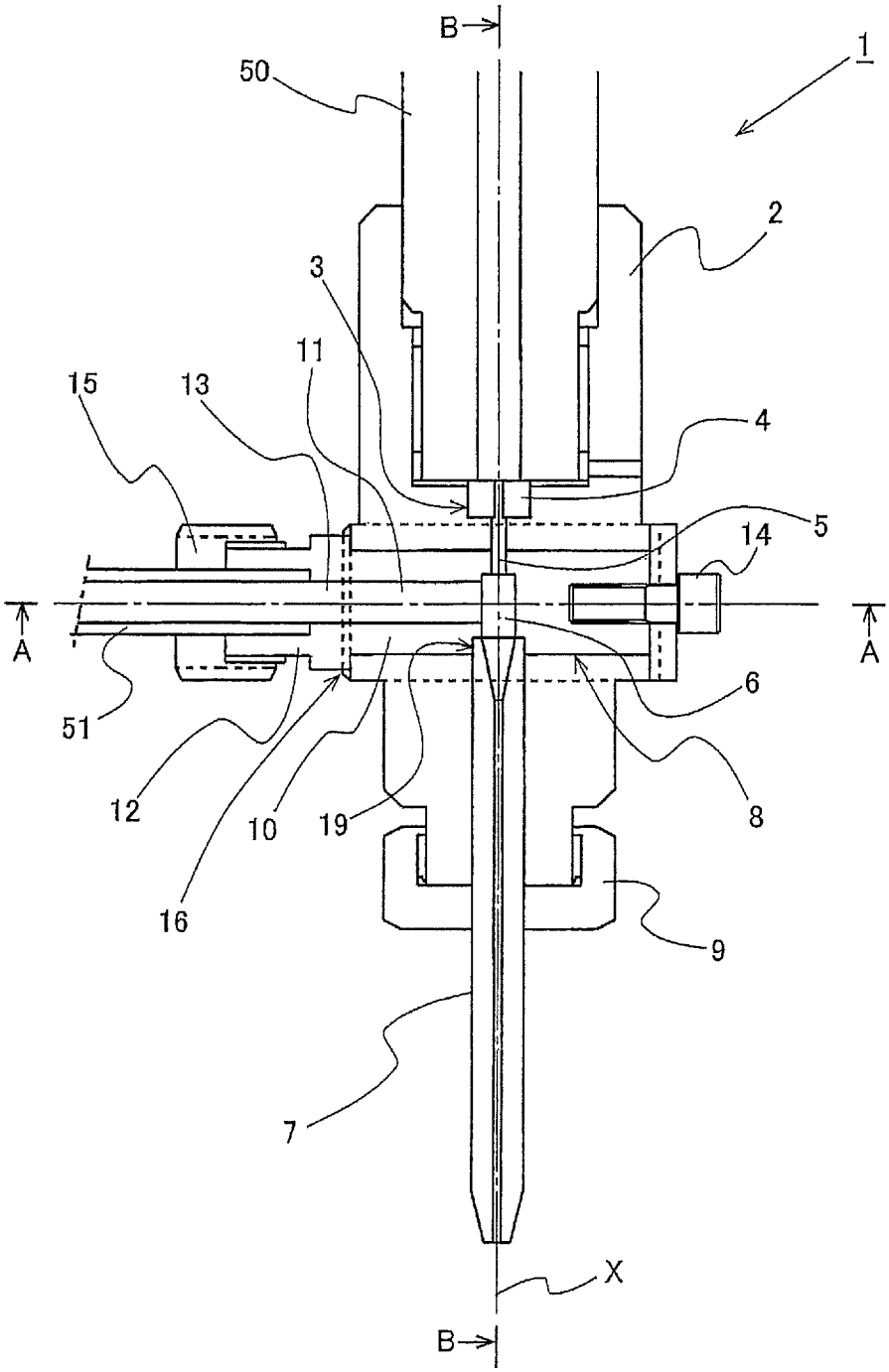
FIG. 1 is a schematic longitudinal sectional view showing the configuration of an abrasive nozzle head according to one embodiment of the present invention.
Figure 2A:
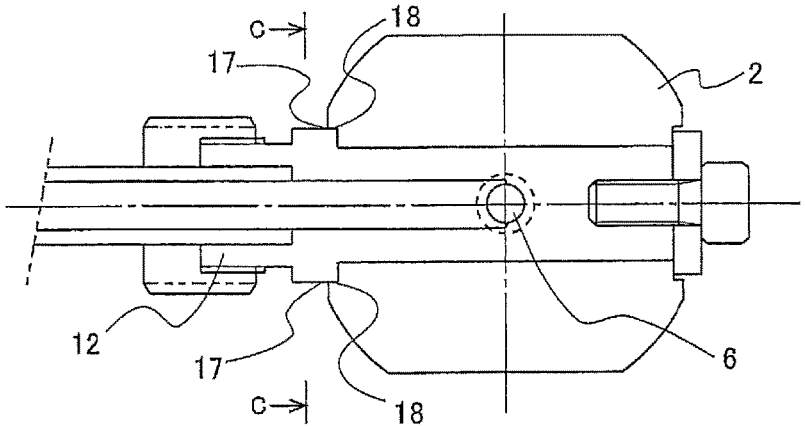
Figure 2B:
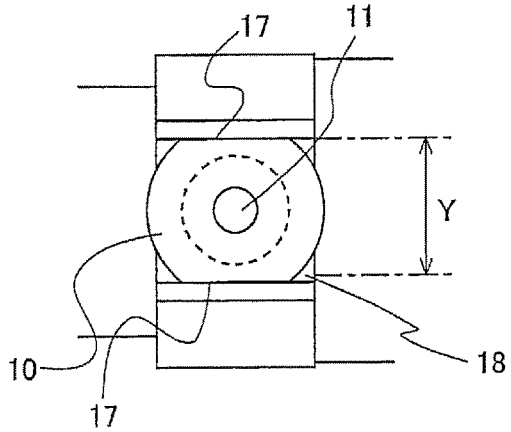
Figure 3A:
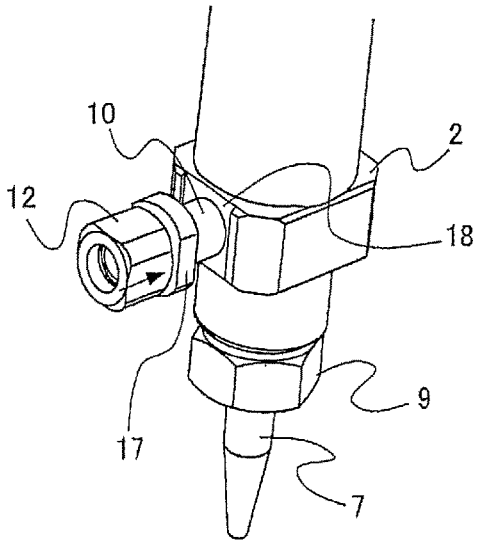
Figure 3B:
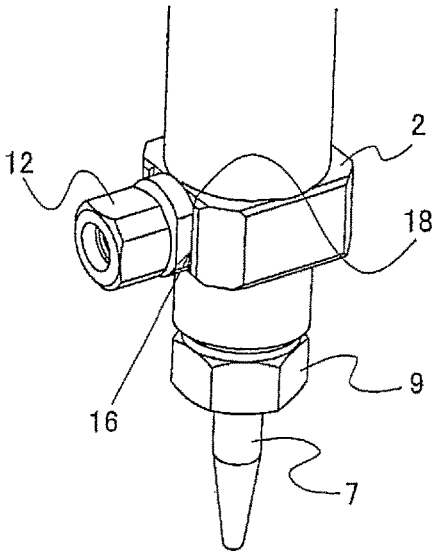

An abrasive nozzle head according to the present invention includes a hollow head body that is mounted to a nozzle adapter supplying high pressure water. The interior of the head body includes: a water nozzle that jets high pressure water; a mixing chamber where a abrasive is mixed into a water jet from the water nozzle; and an abrasive nozzle that discharges an abrasive water jet from the mixing chamber. The water nozzle, the mixing chamber, and the abrasive nozzle are arranged coaxially with the nozzle adapter. The abrasive nozzle head is provided with a abrasive supply portion for supplying the abrasive to the mixing chamber through the head body. A recessed hole intersecting with a jet axis of the water jet is formed by drilling from a side surface of the head body. A mixer member is formed with: the mixing chamber; and a abrasive supply port introducing the abrasive into the mixing chamber. The mixer member is removably inserted into the recessed hole from outside the head body. When the mixer member is fully inserted, the mixing chamber is positioned coaxially with the water nozzle and the abrasive nozzle by a positioning portion. The mixer member in the fully inserted position is releasably fixed by a fixing portion.

Thus, in the present invention, the mixer member can be easily replaced only by releasing the fixing portion and removing and inserting the mixer member from and into the recessed hole of the head body without disassembling the whole nozzle head, leading to a great reduction in working time. As the fixing portion, a simple mechanism, such as a bolt, can be used. In this case, the inserted position of the mixer member is fixed by a bolt that passes through the side wall of the head body and is threaded into the leading end of the mixer member, and the work of insertion, removal, or replacement of the mixer member can be performed simply by loosening the bolt.

Furthermore, in the present invention, the mixing chamber is positioned coaxially with the water nozzle and the abrasive nozzle by the positioning portion at the same time as the completion of the insertion of the mixer member into the recessed hole. If the positioning portion is made up of fitting portions that are formed on an outer peripheral portion of the mixer member and around the opening of the recessed hole and shaped to fit each other, the positioning is performed simply by inserting the mixer member into the recessed hole in such a manner that the fitting portions are fitted together, and the axial alignment of the mixing chamber can be easily completed at the same time as the completion of the insertion of the mixer member.

It should be noted that, in the present invention, the water nozzle is not mounted to the mixer member, that is, disposed in the head body separately from the mixer member, so that the insertion/removal of the mixer member into/from the recessed hole of the head body is performed without affecting the water nozzle. Thus, in contrast to the related art, the replacement of the mixer member is unaccompanied by the removal of the water nozzle that is of different replacement timing from the mixer member. Consequently, the problem of the early occurrence of seal failure due to the unnecessary removal work of the water nozzle is avoided.

Such arrangement configuration, in which the water nozzle is separate from the mixer member, may include the following simple configuration. The head body is formed with a recess on the downstream end side of the nozzle adapter, and provided with a flow passage that extends coaxially with the nozzle adapter so as to communicate with the mixing chamber of the mixer member inserted into the recessed hole from the center of a bottom of the recess, and the water nozzle is replaceably fitted and disposed in the recess. In this case, the water nozzle can be easily taken out from the head body simply by removing the head body from the nozzle adapter, and easily replaced independently of the mixer member.

Furthermore, a abrasive supply hose for supplying the abrasive into the mixing chamber of the mixer member from the outside needs to be connected to the abrasive supply port of the mixing chamber. On the other hand, in the present invention, because the mixer member is inserted into the recessed hole of the head body from the outside, the rear end of the mixer member protrudes outward of the head body. Therefore, the abrasive supply port is provided in the rear end so as to open outward, and thus the simple abrasive supply portion for connecting the abrasive supply hose at the rear end may be configured. In this case, the rear end and the abrasive supply hose may be connected through a separate hose adapter, or alternatively, the arrangement may be such that the adapter is formed integrally with the rear end.

In the case of the separate hose adapter as in the related art, not only there has been the possibility of a product error or assembly failure, but also there has been cases where the members are used while there is a relatively large difference in wear condition therebetween because the replacement timing is not always the same as the mixer member and because of user demand to maintain the service life as long as possible. The difference in wear condition could also cause abrasive supply failure, and result in cutting failure when the abrasive water jet cutting device is used. On the other hand, as described above, in the configuration being such that the abrasive supply hose adapter is provided integrally with the mixer member, there is no problem of a product error or mounting failure between the members, and wear occurs integrally. Therefore, the possibility of abrasive supply failure and cutting failure caused thereby is eliminated, and service life management is also facilitated.

Moreover, in the present invention, the arrangement configuration may be such that the abrasive nozzle communicating with the mixing chamber, at an upstream end thereof, is fitted in a nozzle recess provided downstream from the mixer member in the fully inserted position, and attached to the head body. With this configuration, the abrasive nozzle and the mixer member are arranged without spacing therebetween, and wear due to the interposition of the abrasive water jet between the members can be made less likely to occur. In this case, it is only necessary to release the fitting between the abrasive nozzle and the mixer member before removal of the mixer member, more specifically, to move downward the abrasive nozzle in the head body or remove the abrasive nozzle from the head body. Therefore, the replacement work of the mixer member can still be performed more easily in a shorter time than in the related art in which the disassembly of the whole nozzle head has been necessary, It should be noted that, in the present invention, there is no need for limiting the direction in which the mixer member is inserted into the head body, that is, the direction in which the recessed hole intersects with respect to the central axis of the head body along the jet axis of the water jet, to a specified direction, such as the direction perpendicular to the direction of the jet axis, and the intersecting direction can be set at any tilt angle as appropriate. Since this intersecting direction is substantially equivalent to the direction in which the abrasive supply hole extends to the mixing chamber, the intersecting angle is the merging angle of the abrasive with respect to the water jet. Therefore, preferably, the intersecting angle at which the abrasive merges into the water jet is selected in accordance with the water jet used and the abrasive supply conditions.

An abrasive nozzle head 1 according to one embodiment of the present invention is shown in the schematic longitudinal sectional view of FIG. 1. The abrasive nozzle head 1 according to this embodiment is composed mainly of: a hollow head body 2 that is mounted to a nozzle adapter 50 supplying high pressure water; a water nozzle 4 that jets the high pressure water from the nozzle adapter 50 downstream; a mixing chamber 6 where a abrasive is mixed into a water jet from the water nozzle 4; and an abrasive nozzle 7 that discharges an abrasive water jet from the mixing chamber 6. The water nozzle 4, the mixing chamber 6, and the abrasive nozzle 7 are arranged within the head body 2 coaxially with the nozzle adapter 50. The abrasive nozzle head 1 is provided with a abrasive supply portion for supplying the abrasive to the mixing chamber 6 through the head body 2.

The water nozzle 4 is fitted and disposed in a water nozzle recess 3 that is formed in the head body 2 on the downstream end side of the nozzle adapter 50. Furthermore, in the head body 2, a recessed hole 8 is formed by drilling from a side surface. The recessed hole 8 is located downstream from the water nozzle recess 3 and the water nozzle 4, and intersects perpendicularly with respect to the jet axis X of the water jet coaxial with the central axis of the nozzle adapter 50.

In the abrasive nozzle head 1 according to this embodiment, a mixer member 10 formed with the mixing chamber 6 and a abrasive supply port 11 is removably inserted into the recessed hole 8. At the same time as the completion of the insertion of the mixer member 10 into the recessed hole 8 through a positioning portion, the mixing chamber 6 is positioned coaxially with the jet axis X in the head body 2, that is, its coaxial arrangement with respect to the water nozzle 4 and the abrasive nozzle 7 is also completed. Then this fully inserted position is fixed by a fixing portion, thereby completing the mounting of the mixer member 10 to the head body 2.

Furthermore, in this embodiment, a hose adapter 12 for connecting a abrasive supply hose 51 is integrally formed on a rear end opposite the insertion side of the mixer member 10. The abrasive supply hose 51 is connected and fixed to the hose adapter 12 by a fixing nut 15, thereby bringing the abrasive supply port 11, which extends from the mixing chamber 6 to the rear end of the mixer member 10, into communication with the abrasive supply hose 51 through a passage 13 in the hose adapter 12.

Further, fitting portions 16 are used as the positioning portion for completing the alignment of the mixing chamber 6 at the same time as the completion of the insertion of the mixer member 10. The fitting portions 16 are formed on an outer peripheral portion of the mixer member 10 and around the opening of the recessed hole 8, and shaped to fit each other. The fitting portions are fitted together simply by inserting the mixer member 10 into the recessed hole 8, and thus positioning is made. More specifically, as a simple and preferred configuration, as shown in FIGS. 2A, 2B, 3A, and 3B, a fitting mechanism between a pair of facing parallel chamfered surfaces 17, which are formed on the mixer member 10 side, and a fitting groove 18 with walls on both sides thereof, which has a width corresponding to the distance between the chamfered surfaces 17 and is formed around the opening of the recessed hole 8 of the head body 2, is used.

In this embodiment, because the hose adapter 12 is integrally formed on the rear end of the mixer member 10, a cylindrical radially-enlarged portion is provided on the outer periphery of a boundary portion between the mixer member 10 and the hose adapter 12, and the pair of parallel chamfered surfaces 17 are formed on regions of the cylindrical portion which face a direction perpendicular to the direction of the central axis of the mixing chamber 6. On the head body 2 side, the outer periphery of the region formed with the recessed hole 8 is radially enlarged, and the fitting groove 18 is formed around the opening of the recessed hole 8 along the direction of the jet axis X. The fitting groove 18 has both side walls spaced apart a distance to conform to the spacing between the pair of chamfered surfaces 17 and is shaped to fit the pair of chamfered surfaces 17. Therefore, during the course of inserting the mixer member 10 into the recessed hole 8, positioning can be made simply by inserting the mixer member 10 while adjusting its orientation, and fitting the pair of chamfered surfaces 17 into the fitting groove 18.

It should be noted that, in this embodiment, the mixer member 10 is fixed to the head body 2 by a bolt 14. The bolt 14 passes through a side wall of the head body 2 and is threaded into a leading end portion of the mixer member 10 which is in an inserted position. At this time, a flow passage 5 extending downstream from the center of the bottom of the water nozzle recess 3 is formed in the head body 2 so as to allow communication between the orifice of the water nozzle 4 and the mixing chamber 6.

Figure 4A:
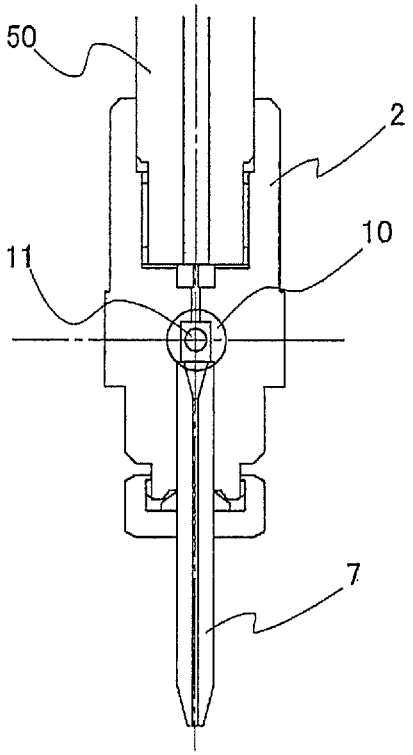
Figure 4B:
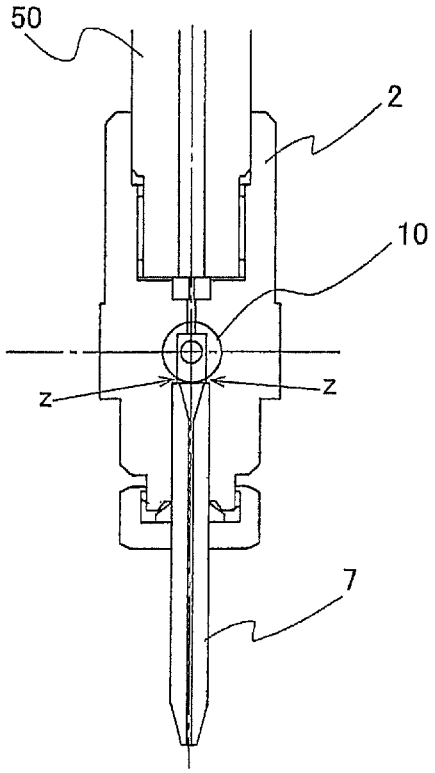

Furthermore, in this embodiment, as shown in FIGS. 1 and 4A, the mixer member 10 is provided with an abrasive nozzle recess 19 into which an upstream end portion of the abrasive nozzle 7 is fitted while the mixer member 10 is in a fully inserted position. That is, the abrasive nozzle 7, with the upstream end portion fitted in the abrasive nozzle recess 19, is attached to the head body 2, thereby bringing the flow passage of the abrasive nozzle 7 into communication with the downstream end of the mixing chamber 6. As described above, when the abrasive nozzle 7 with the upstream end portion fitted in the abrasive nozzle recess 19 of the mixer member 10 is mounted, gaps z, such as shown in FIG. 4B, which are formed between the members when the abrasive nozzle 7 in a non-fitted position is mounted, are eliminated. Therefore, there is no possibility that an abrasive water jet is interposed in the gaps Z and causes remarkable wear on its surrounding members.

In the abrasive nozzle head 1 according to this embodiment including the above-described configuration, the replacement work of the mixer member 10 can be performed by the following procedure. That is, the mixer member 10 can be removed from the head body 2 simply by loosening the fixing of a fixing nut 9 that fixes the abrasive nozzle 7 to the head body 2; removing or displacing downward the abrasive nozzle 7 from the head body 2; releasing the fitting of the mixer member 10 into the abrasive nozzle recess 19; removing the bolt 14; and removing the mixer member 10 from the recessed hole 8. And then, a new mixer member 10 is inserted into the recessed hole 8 and fixed with the bolt 14, and then the abrasive nozzle 7 is reinstalled and fixed to the head body 2 with the fixing nut 9, thereby completing the replacement of the mixer member 10.

As described above, according to this embodiment, the replacement of the mixer member 10 can be performed by about four steps. Therefore, the working process is drastically simplified in comparison with the related art which has required at least eight steps, and a reduction in working time is achieved. Furthermore, the replacement work of the mixer member 10 exerts no influence upon the water nozzle 4.

In the related art, at least ten steps have been necessary for the replacement work of the water nozzle as well as the mixer member, while in this embodiment, the replacement work of the water nozzle 4 can be completed in only a total of four steps in which the water nozzle 4 can be removed from the head body 2 by removing the head body 2 from the nozzle adapter 50, and then a new water nozzle 4 is mounted into the head body 2 and attached to the nozzle adapter 50 of the head body 2.

In the above-described embodiment, there has been described the case where the configuration is such that the direction in which the recessed hole is formed by drilling in the head body, and in which the mixer member is inserted, intersects perpendicularly with respect to the jet axis X of the water jet. However, in the invention, the intersecting direction is not limited thereto, but also can be set at any tilt angle as appropriate.

Figure 5:
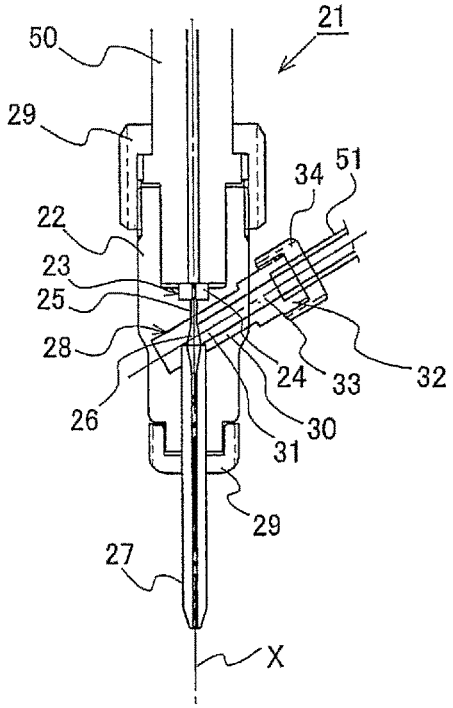
FIG. 5 is a schematic longitudinal sectional view showing the configuration of an abrasive nozzle head according to another embodiment of the present invention.
Figure 6:
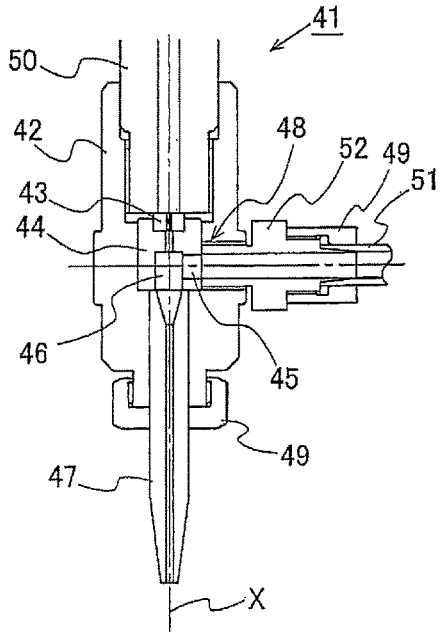
FIG. 6 is a schematic longitudinal sectional view showing an example of known abrasive nozzle heads.

If the tilt angle of the intersecting direction with respect to the jet axis X is set as appropriate, for example in the range of 45 to 60° in the same manner as an abrasive nozzle head 21 shown in FIG. 5, the abrasive is supplied to a abrasive supply port 31 not only by negative pressure suction but also by its own weight, thereby allowing more efficient mixing into the water jet than the case of perpendicular intersection. Furthermore, the abrasive supply time lag is reduced by its own weight, and therefore, especially if the workpiece is made of a material, such as a carbon fiber reinforced plastic, in which cracking or chipping is likely to occur during piercing, the occurrence of cracking or chipping can also be suppressed. Further, the cutting speed can be increased and cut surface quality can be improved by the water nozzle diameter and the abrasive nozzle diameter in comparison with the case of perpendicular intersection.

The abrasive nozzle head 21 in FIG. 5 includes a common configuration with the abrasive nozzle head 1 shown in FIG. 1 except that the intersecting direction with respect to the jet axis X has a tilt angle.

That is, the abrasive nozzle head 21 includes, within a hollow head body 22 mounted to the nozzle adapter 50 supplying high pressure water: a water nozzle 24 that jets the high pressure water from the nozzle adapter 50 downstream; a mixing chamber 26 where a abrasive is mixed into a water jet from the water nozzle 24; and an abrasive nozzle 27 that discharges an abrasive water jet from the mixing chamber 26. The water nozzle 24, the mixing chamber 26, and the abrasive nozzle 27 are arranged coaxially with the jet axis X.

The water nozzle 24 is fitted and disposed in a recess 23 that is formed on the downstream end side of the nozzle adapter 50 in the head body 22. In the head body 22, a recessed hole 28 is formed by drilling from a side surface. The recessed hole 28 is located downstream from the recess 23 and the water nozzle 24, intersects at a tilt angle of about 45 to 60° with respect to the jet axis X of the water jet coaxial with the central axis of the nozzle adapter 50. A mixer member 30 formed with the mixing chamber 26 and the abrasive supply port 31 is removably inserted into the recessed hole 28, and this inserted position is fixed, thereby completing the coaxial arrangement of the mixing chamber 26 with respect to the jet axis X in the head body 22.

Furthermore, a hose adapter 32 for connecting the abrasive supply hose 51 is integrally formed on a rear end of the mixer member 30, and the abrasive supply port 31 extending from the mixing chamber 26 to the rear end of the mixer member 30 is brought into communication with the abrasive supply hose 51 through a flow passage 33 in the hose adapter 32. Here, the direction in which the abrasive supply port 31 extends matches the direction in which the recessed hole 28 and the mixer member 30 intersect with respect to the jet axis X. Therefore, the merging angle at which the abrasive merges into the water jet through the abrasive supply port 31 becomes a selected tilt angle in the above-described range of about 45 to 60°.

Also in the abrasive nozzle head 21, the water nozzle 24 is fitted and disposed in the recess 23 that is formed on the downstream end side of the nozzle adapter 50 in the head body 22, and the recessed hole 28 is formed by drilling from a side surface of the head body 22 downstream from the recess 23 and the water nozzle 24. It is therefore possible to complete the replacement of the mixer member 30, without exerting any influence upon the water nozzle 24, in the working process that is drastically simplified and reduced in working time in comparison with the related art.

What is claimed is:

1. An abrasive nozzle head comprising, a hollow head body that is mounted to a nozzle adapter supplying high pressure water when in use, the interior of the head body including:

a water nozzle that jets the high pressure water;

a mixing chamber where an abrasive is mixed into a water jet from the water nozzle; and an abrasive nozzle that discharges an abrasive water jet from the mixing chamber, the water nozzle, mixing chamber, and abrasive nozzle being arranged coaxially with the nozzle adapter, the abrasive nozzle head being provided with an abrasive supply portion that supplies the abrasive to the mixing chamber through the head body, wherein the head body has a recessed hole formed by drilling from a side surface of the head body, the recessed hole intersecting with a jet axis of the water jet, and wherein the abrasive nozzle head includes:

a mixer member that is removably inserted into the recessed hole from outside the head body, and formed with the mixing chamber and an abrasive supply port introducing the abrasive into the mixing chamber;

a positioning portion that positions the mixing chamber coaxially with the water nozzle and the abrasive nozzle when the mixer member is fully inserted, the positioning portion comprising fitting portions that are formed on an outer peripheral portion of the mixer member and around an opening of the recessed hole and shaped to fit each other; and a fixing portion that releasably fixes the fully inserted position of the mixer member, wherein with the fitting portions fitted together, the mixing chamber is positioned coaxially with the water nozzle and the abrasive nozzle, thereby providing the fully inserted position of the mixer member.

2. The abrasive nozzle head according to claim 1, wherein the abrasive supply portion comprises an abrasive supply hose adapter that is integrally provided on the mixer member, the abrasive supply hose adapter having a flow passage, the flow passage communicating with the abrasive supply port.

3. The abrasive nozzle head according to claim 1, wherein the head body has: a recess that is formed on the downstream end side of the nozzle adapter; and a flow passage that extends coaxially with the nozzle adapter from the center of a bottom of the recess so as to communicate with the mixing chamber of the mixer member inserted into the recessed hole, and the water nozzle is replaceably fitted and disposed in the recess.

4. The abrasive nozzle head according to claim 1, wherein the mixer member is provided with an abrasive nozzle recess in which, with the mixer member in the fully inserted position, an upstream end portion of the abrasive nozzle can be fitted.

5. An abrasive water jet cutting device comprising the abrasive nozzle head according to claim 1.

* * * * *